US006467769B2

(12) United States Patent
Boss

(10) Patent No.: US 6,467,769 B2
(45) Date of Patent: Oct. 22, 2002

(54) OUTPUT BIN FOR PRINTING DEVICES

(75) Inventor: Roland Boss, Jalisco (MX)

(73) Assignee: Hewlett-Packard Co., Palo Alto, CA (US)

( * ) Notice: Subject to any disclaimer, the term of this patent is extended or adjusted under 35 U.S.C. 154(b) by 0 days.

(21) Appl. No.: 09/816,819

(22) Filed: Mar. 22, 2001

(65) Prior Publication Data

US 2002/0135121 A1 Sep. 26, 2002

(51) Int. Cl.[7] ..... B65H 31/00
(52) U.S. Cl. ..... 271/207; 270/58.08; 227/39
(58) Field of Search ..... 271/207, 145, 271/209, 210; 227/39; 270/58.08

(56) References Cited

U.S. PATENT DOCUMENTS

| | | | | | |
|---|---|---|---|---|---|
| 3,881,605 | A | * | 5/1975 | Grossman | 271/210 |
| 3,946,879 | A | * | 3/1976 | Jensen | 271/210 |
| 4,220,323 | A | * | 9/1980 | Smith | 271/207 |
| 4,238,066 | A | * | 12/1980 | Brooke | 271/207 |
| 4,861,213 | A | * | 8/1989 | Fuchs | 271/207 |
| 5,058,878 | A | * | 10/1991 | Hochbein et al. | 271/145 |

FOREIGN PATENT DOCUMENTS

| | | | | |
|---|---|---|---|---|
| JP | 0019642 | * | 1/1985 | 271/207 |
| JP | 0215465 | * | 9/1987 | 271/207 |
| JP | 406263310 A | * | 9/1994 | 271/207 |

OTHER PUBLICATIONS

Fernandez, Copy Inverting Tray, Jun.–1979, Xerox Disclosure Journal, vol. 4, No. 3, p. 317.*

* cited by examiner

*Primary Examiner*—H. Grant Skaggs

(57) ABSTRACT

An output bin that uses gravity to urge the sheets into alignment along two edges and thereby help form a fully aligned stack. In one embodiment, the bin includes a first panel facing each sheet as the sheet is output from the printing device, the first panel having a top, a bottom and a side; a second panel disposed along the bottom of the first panel, the second panel tipped relative to a leading edge that leads each sheet out of the printing device; and a third panel disposed along the side of the first panel. Each sheet dispensed into the output bin slides over the first panel until a leading edge of the sheet contacts an upper portion of the second tipped panel. The sheet then tips in the direction of the third panel and rests with the leading edge supported by the second panel and a side edge supported by the third panel.

18 Claims, 12 Drawing Sheets

OUTPUT BIN FOR PRINTING DEVICES

FIELD OF THE INVENTION

The invention relates to an output bin for printers, copiers, and other printing devices that output sheet media. More particularly, the invention relates to a bin for capturing and aligning, in a stack, sheet media dispensed from a printing device.

BACKGROUND

In conventional printing devices such as laser and ink printers, copiers, and facsimile machines, sheets are dispensed one after the other forming stacks in one or more bins or trays located within or near the device. In many instances it is desirable to staple, bind, punch, or cut the stack of sheets collected in a bin. Before such finishing operations can be performed, the edges and corners of the sheets in the stack must be aligned. Referring to FIG. 1, the support surface 10 of some bins 12 is sloped allowing each sheet 14 to slide into place over the top of a sheet 14 previously dispensed into the bin 12 forming a stack 16. Such bins 12 include a floor or stop 18 located near the base of the sloped support surface 10. Gravity, forcing each sheet 14 down the sloped surface 10, aligns the bottom edge of each sheet 14 in the stack 16 against the stop 18. As can be seen in FIG. 2, however, this scheme often fails to align the side edge 20 of the sheets 14 in the stack 16, so additional adjustments are needed before a finishing operation can be performed. More sophisticated bins incorporate mechanical devices for fully aligning the sheets in a stack. However, these mechanical solutions can significantly increase the cost of a printing device. What is needed is a relatively inexpensive bin capable of forming a fully aligned stack of sheets without slowing the output speed of the printing device.

SUMMARY

Accordingly, the present invention is directed to an output bin that uses gravity to urge the sheets into alignment along two edges and thereby help form a fully aligned stack. In one embodiment, the bin includes a first panel facing each sheet as the sheet is output from the printing device, the first panel having a top, a bottom and a side; a second panel disposed along the bottom of the first panel, the second panel tipped relative to a leading edge that leads each sheet out of the printing device; and a third panel disposed along the side of the first panel. Each sheet dispensed into the output bin slides over the first panel until a leading edge of the sheet contacts an upper portion of the second tipped panel. The sheet then tips in the direction of the third panel and rests with the leading edge supported by the second panel and a side edge supported by the third panel.

DETAILED DESCRIPTION

Figure 1:
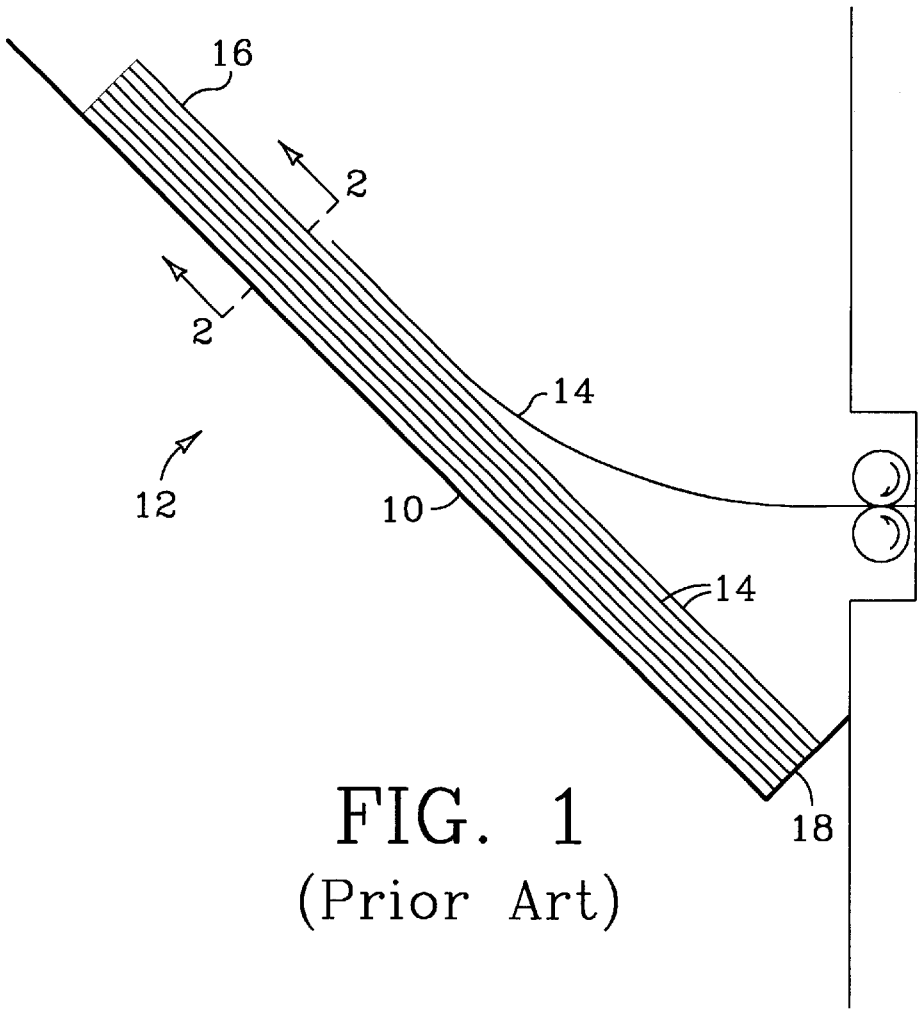
FIG. 1 (Prior Art)
FIG. 1 is a side plan view of a conventional output bin.
Figure 2:
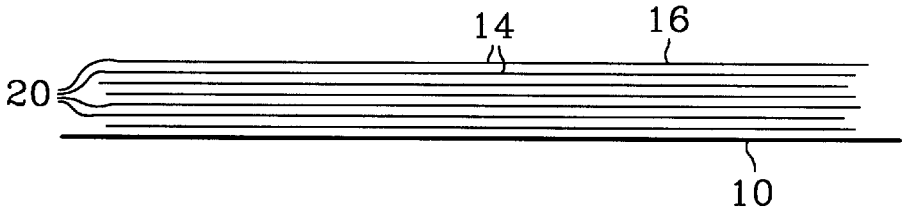
FIG. 2 (Prior Art)
FIG. 2 is a section view taken along the line 2—2 in FIG. 1 showing misaligned side edges of sheets collected in the bin.
Figure 3:
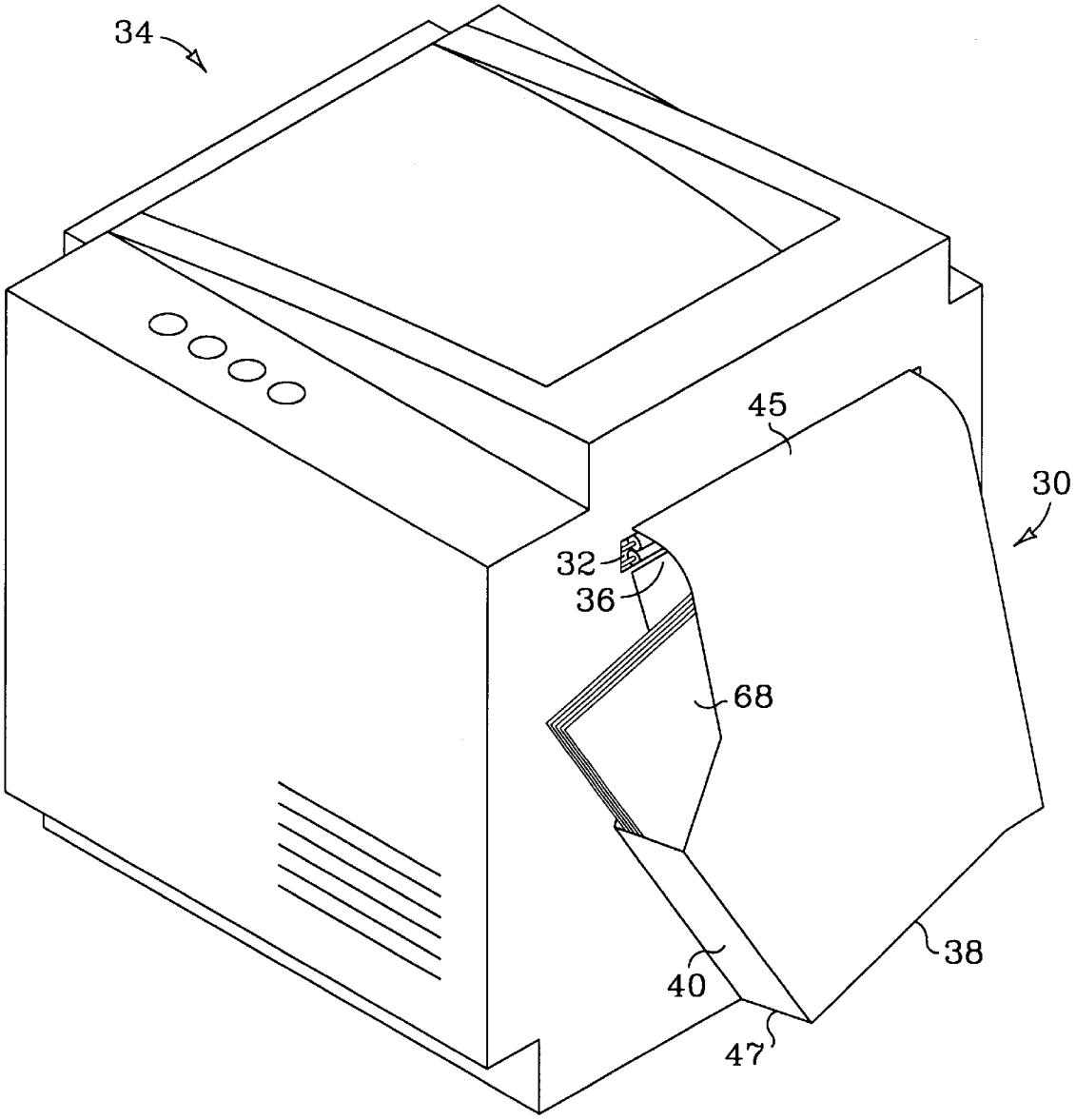
FIG. 3 is a perspective view of one embodiment of the invented sheet media bin coupled to the rear output of a printer.
Figure 5:
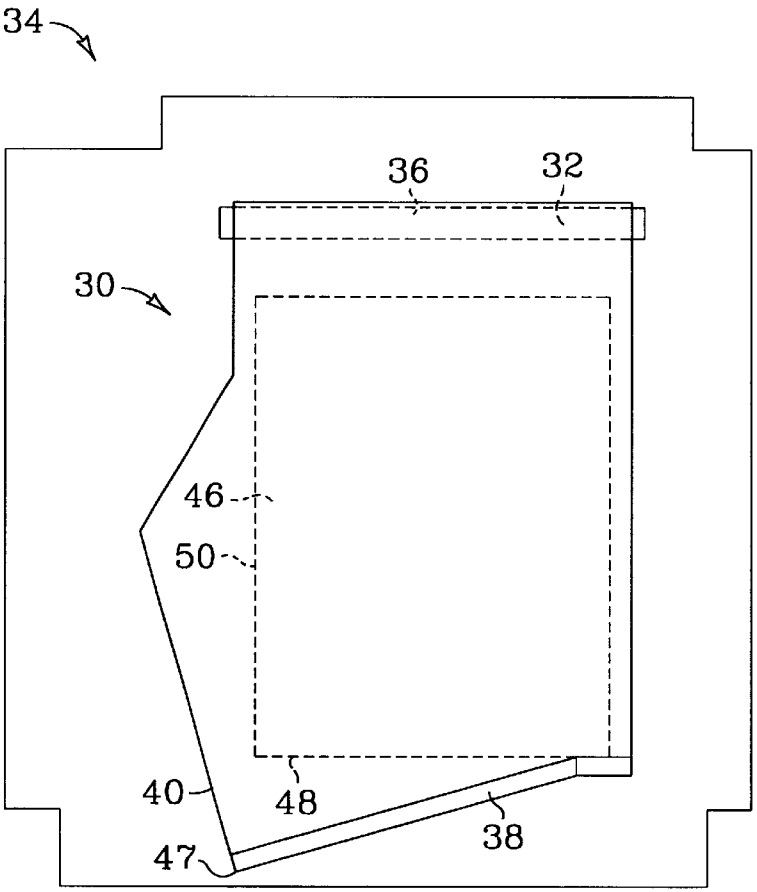
FIGS. 4–7 are elevation side views of one embodiment of the invented sheet media alignment bin, showing, in sequence, a sheet entering the bin, falling to the bin's floor and tipping to one side against the stop.
Figure 4:
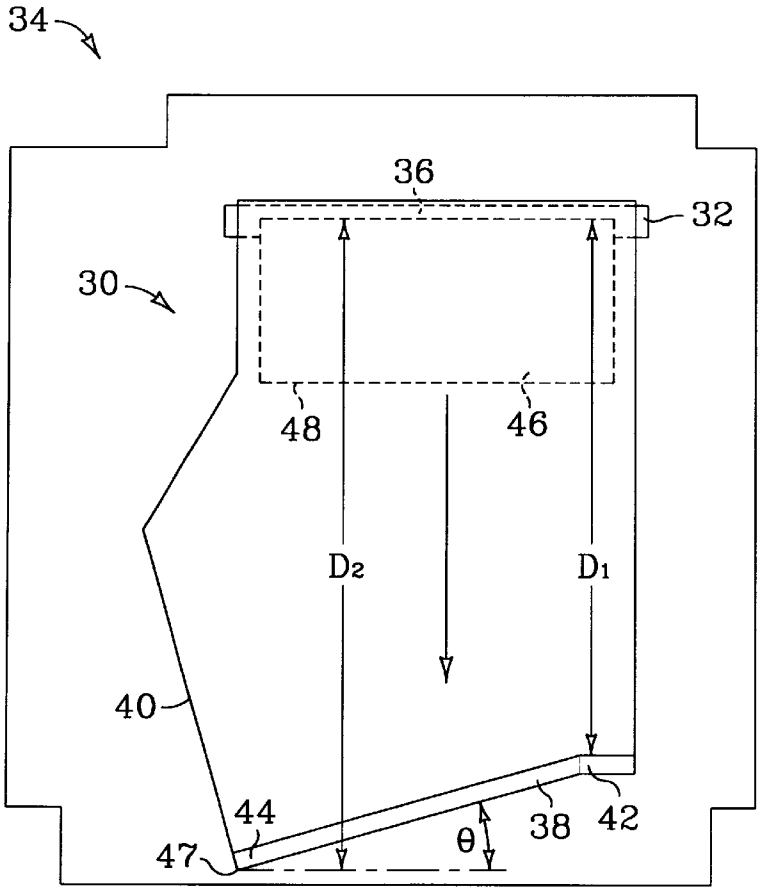

The invented output device is designed for use with or as an integrated part of any printer, copier, or other printing device in which it may be desirable to fully align sheets in an output stack. The following description and the drawings illustrate only a few exemplary embodiments of the invention. Other embodiments, forms, and details may be made without departing from the spirit and scope of the invention, which is expressed in the claims that follow this description.

FIGS. 3–7 illustrate one embodiment of the invented alignment bin 30 situated near output 32 of printer 34. Bin 30 includes an opening 36 through which sheets enter the bin, a tipped floor 38, and a stop 40. Tipped floor 38 has a upper portion 42 located a first distance D1 from opening 36 and a lower portion 44 located a second greater distance D2 from opening 36. Second distance D2 is selected to create a tip angle θ sufficient to allow sheet 46 to tip easily in the direction of stop 40 under the force of gravity. Preferably, tip angle θ is big enough to make floor 38 steep enough to allow each sheet to slide into stop 40 if necessary to account for any misalignment as the sheet drops into the corner of bin 30. In the embodiment illustrated in FIGS. 3–7, opening 36 includes guide 45 which functions to direct each sheet dispensed from printer 34 towards floor 38. Referring sequentially to FIGS. 4–7, as printer 34 dispenses sheet 46 through rear output 32 (shown in FIG. 3), guide 45 directs leading edge 48 of sheet 46 toward tipped floor 38. As sheet 46 falls into bin 30, a portion of leading edge 48 makes contact with upper portion 42 of tipped floor 38. Under the force of gravity, sheet 46 tips in the direction of lower portion 44 and stop 40 until its side edge 50 rests against stop 40. Sheet 46 is wedged in corner 47 with side edge 50 supported by stop 40 and leading edge 48 supported by tipped floor 38, Preferably, stop 40 and lower portion 44 of tipped floor 38 occupy perpendicular planes. This alignment allows sheet 46 to fit more securely within bin 30. A stack is formed as additional sheets are dispensed into bin 30. Each additional sheet slides over sheets previously dispensed into bin 30 until that sheet is also supported by tipped floor 38 and stop 40.

In the embodiment shown in FIGS. 3–7, upper portion 42 of floor 38 includes a flat segment 43. Flat segment 43 increases the landing area for sheet leading edge 48 to reduce the risk of damage to the sheet as it falls against floor 38.

Figure 8:
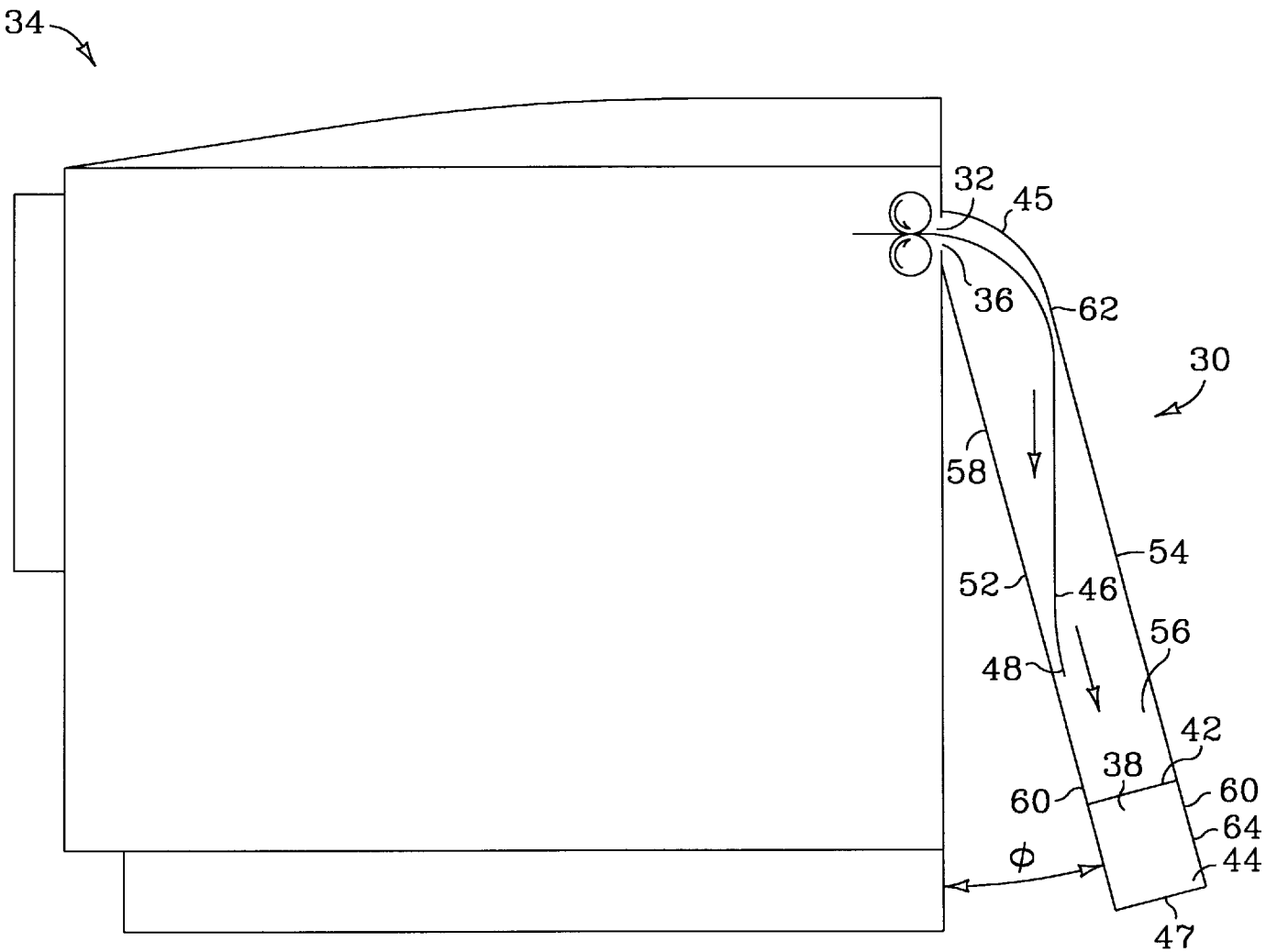
FIGS. 8–9 are elevation side views of one embodiment of the invented sheet media alignment bin incorporating spaced apart support and guide panels.
Figure 9:
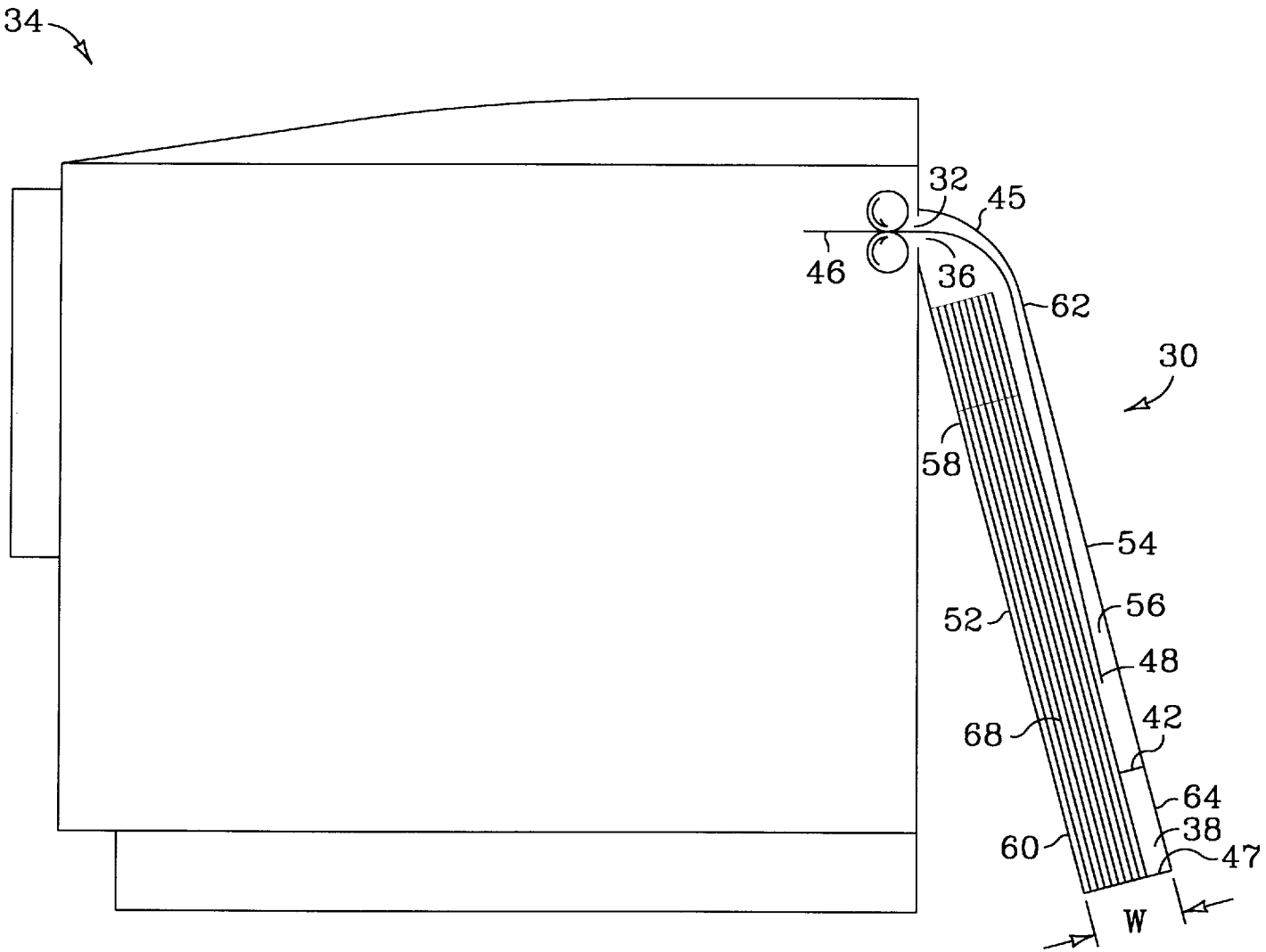

In the embodiment shown in FIGS. 8 and 9, bin 30 also includes spaced apart panels 52 and 54. Occupying parallel planes, inside support panel 52 and outside guide panel 54 define channel 56 in which media sheets are contained. The width W of channel 56 depends upon the number of sheets 46 to be held in bin 34 at one time. Each panel 52 and 54 includes opposing first and second sections 58, 60, 62, and 64. First sections 58 and 62 define opening 36 through which sheets are received from printer 34 into channel 56 with first section 62 incorporating guide 45. Tipped floor 38 and stop 40 are located between second sections 60 and 64 and, as illustrated, may physically connect second sections 60 and 64. Panels 52 and 54 extend down and outward from printer 34 at an angle $\phi$. This orientation allows panel 52 to support, at least indirectly, a face of each sheet 46 as the edges of the sheet are held by tipped floor 38 and stop 40. This added support from panel 52 helps prevent sheet 46 from buckling under the force of gravity. Preferably, support panel 52 lies in a plane that is perpendicular to the plane occupied by stop 40 as well as the plan occupied by lower portion 44 of tipped floor 38. Although it is expected that $\phi$ will usually be quite small to minimize friction between the sheets, this angle may be varied as necessary or desirable in conjunction with floor slant angle $\theta$ and other structural features of bin 30 to optimize the dual edge alignment of each sheet in the stack.

Figure 7:
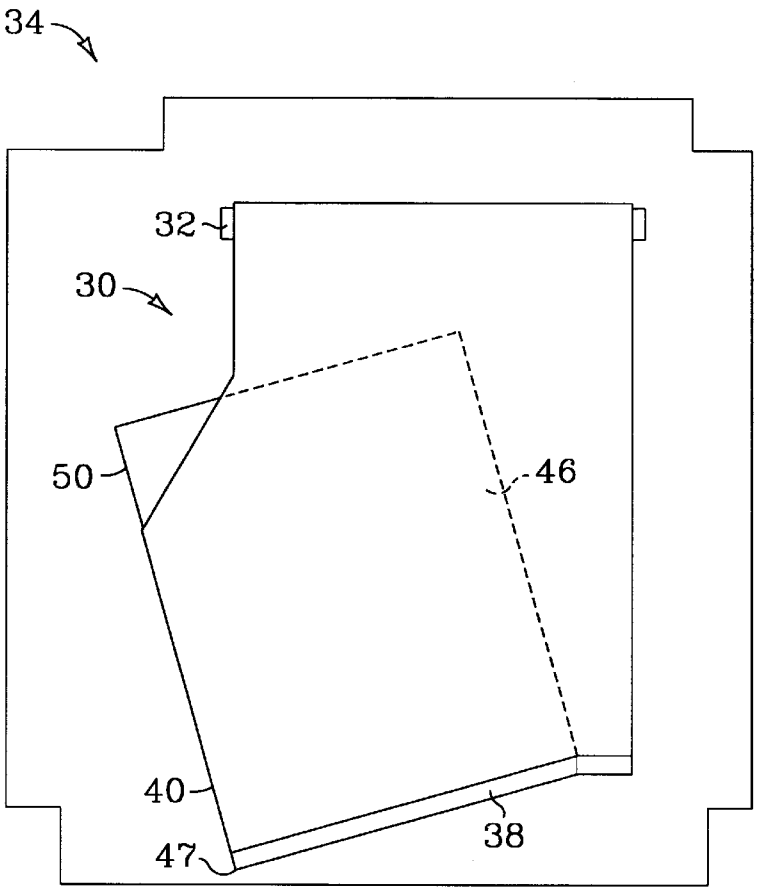
Figure 6:
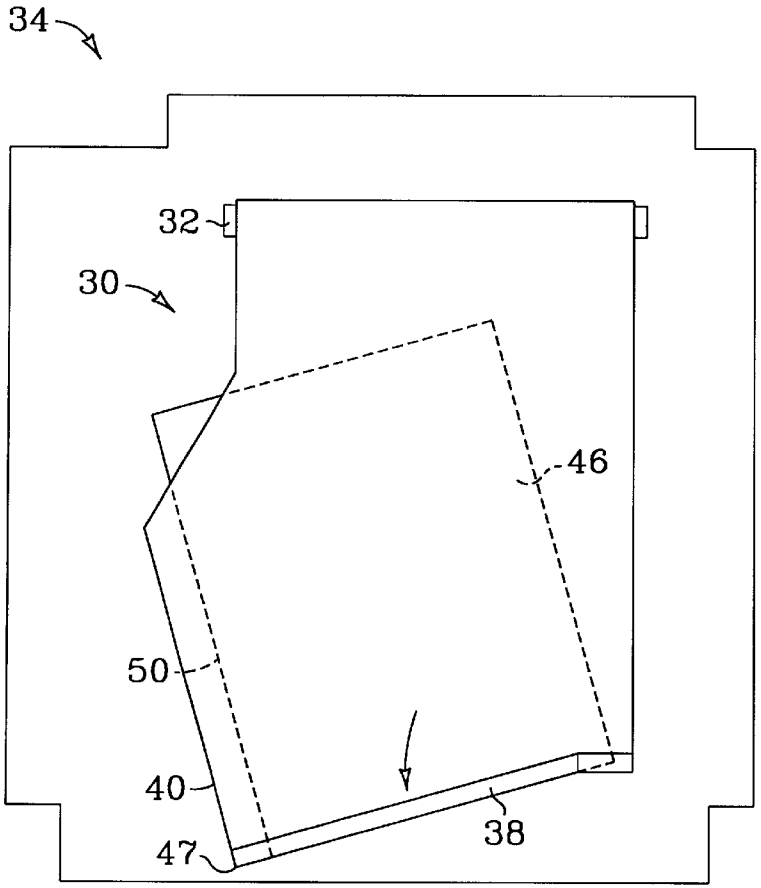

As illustrated in FIG. 9, printer 34 dispenses sheet 46 into opening 36 of bin 30. Directed by guide 45, sheet 46 passes over stack 68 of sheets previously dispensed into bin 34. Sheet 46 slides down over the surface of stack 68 until it hits tipped floor 38. Sheet 46 then tips as illustrated in FIGS. 6–7 and ultimately rests against stop 40 in alignment with the other sheets in stack 68.

Figure 10:
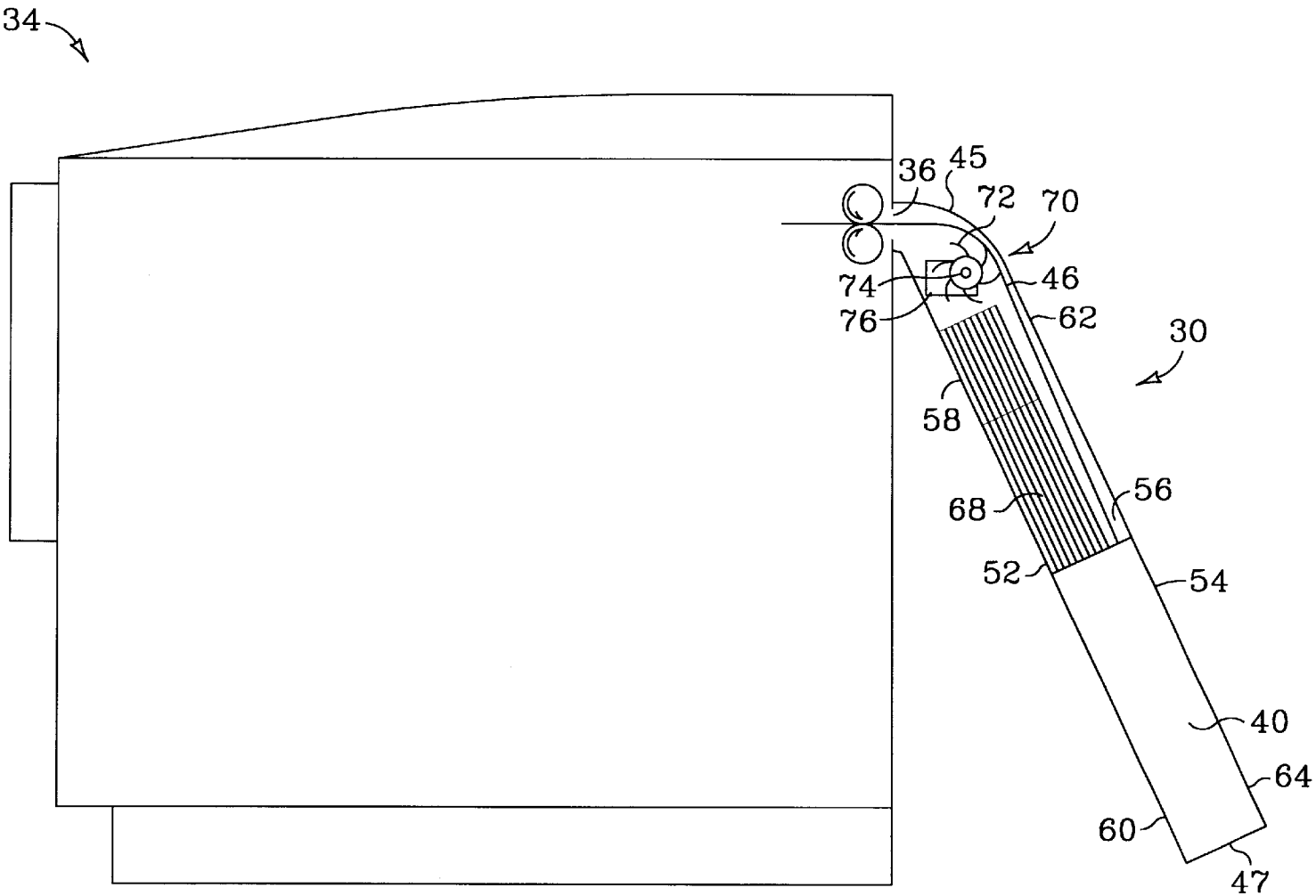
FIG. 10 is an elevation side view of one embodiment of the invented sheet media alignment bin that includes a feeder.

In the embodiment shown in FIG. 10, bin 30 includes a feeder 70 positioned near opening 36 to receive each sheet from printer 34. Feeder 70 may be used to provide an additional mechanical force, for example, if friction between sheet 46 and panel 54 and between sheet 46 and stack 68 impedes the ability of printer 34 to dispense sheet 46 fully into bin 30. In some situations, feeder 70 may also be required if printer 34 dispenses sheets 46 faster than those sheets can slide into place in bin 30 under the force of gravity. Feeder 70, then, increases the rate at which each sheet is dispensed fully into bin 30 preventing input 36 from clogging.

Feeder 70 receives each sheet 46 output from printer 34 urging the sheet over stack 68 allowing sheet 46 to fall into alignment with stack 68 as described above. As illustrated, feeder 70 is a paddle wheel comprised of a series of flexible fingers 72 extending radially outward at selected locations around the outer surface of shaft 74. As motor 76 rotates shaft 74, flexible fingers 72 sequentially contact sheet 46 pressing it against guide panel 54 urging the sheet into bin 30. As each finger 72 contacts sheet 46, that finger conforms to the inside surface of panel 54 providing the friction necessary to urge sheet 46. FIG. 10 illustrates only one possible version of feeder 70. To increase the friction urging sheet 46, feeder 70 could include a plurality of paddle wheels. Alternatively, feeder 70 can be most any mechanical device capable of urging sheets in the direction of tipped floor 38.

It is envisioned that under certain conditions friction between sheet 46 and panel 54 and between sheet 46 and stack 68 may impede sheet 46 from sliding into alignment within bin 30 under the force of gravity. In such cases, shaft 74 of feeder 70 can be oriented such that when rotated, flexible fingers 72 urge each sheet 46 directly into corner 47 (shown in FIGS. 3–7) aligning leading edge 48 with tipped floor 38 and side edge 50 with stop 40. Proper orientation of shafts 74, then, decreases the bin's reliance on gravity to align sheets 46.

Figure 11:
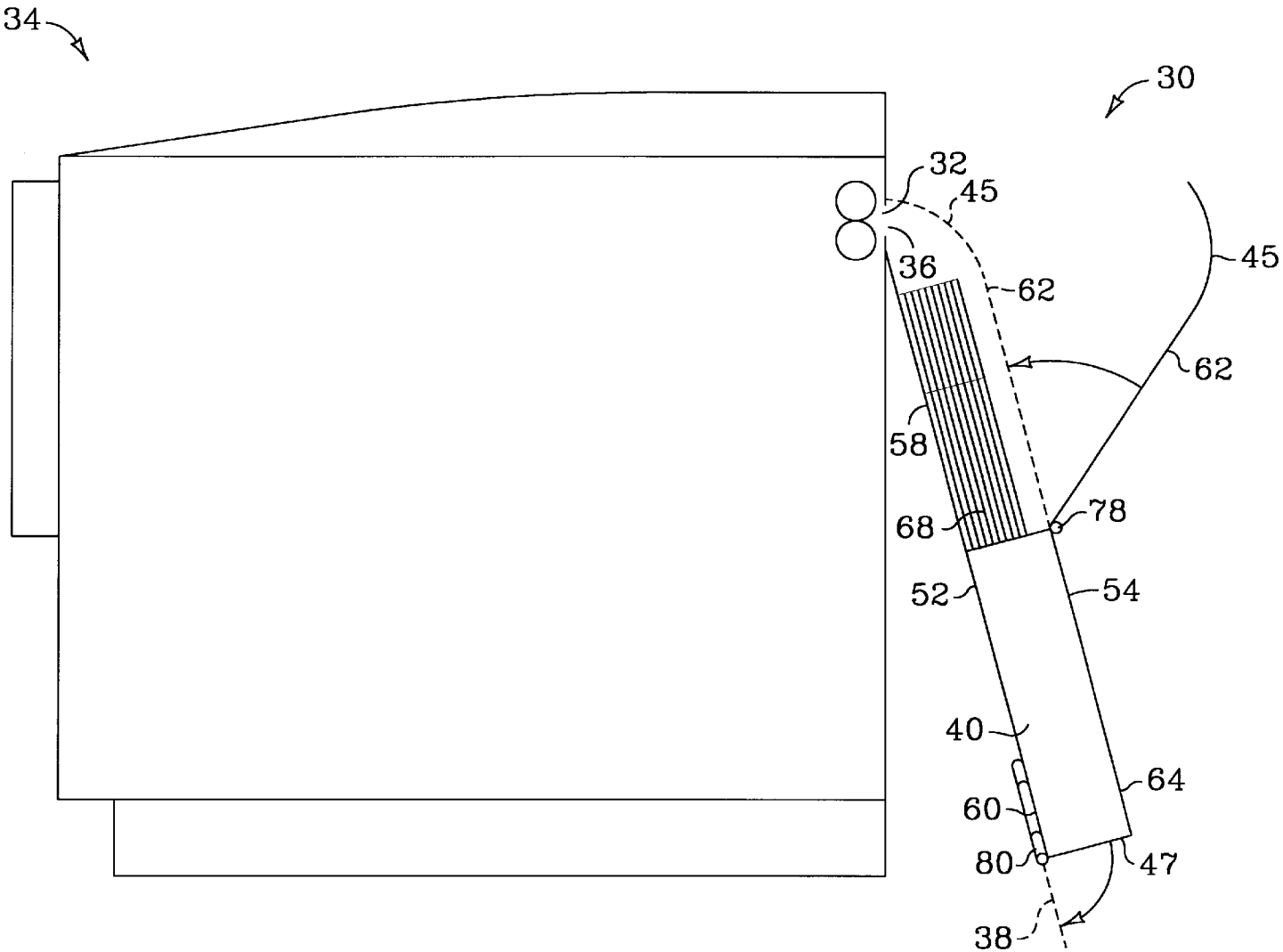
FIG. 11 is an elevation side view of one embodiment in which a hinged guide cover is used to allow easy access to the printed stack, and the tipped floor pivots allowing the aligned sheets to freely slide out of the bin.

In the embodiment shown in FIG. 11, panel 54 includes hinged joint 78 between sections 62 and 64. Joint 78 allows first section 62 of panel 54 to pivot between an open and closed position. In its closed position, first section 62 functions as guide 36. When placed in the open position, aligned stack 68 can be easily removed from bin 30. Additionally, tipped floor 38 may be pivotable between open and closed positions about hinge 80. In its closed position, it serves to support sheets 46 as previously described. In its open position, tipped floor 38 allows sheets 46 to slide out of bin 30 under the force of gravity into a stacker or other sorting device.

Figure 12:
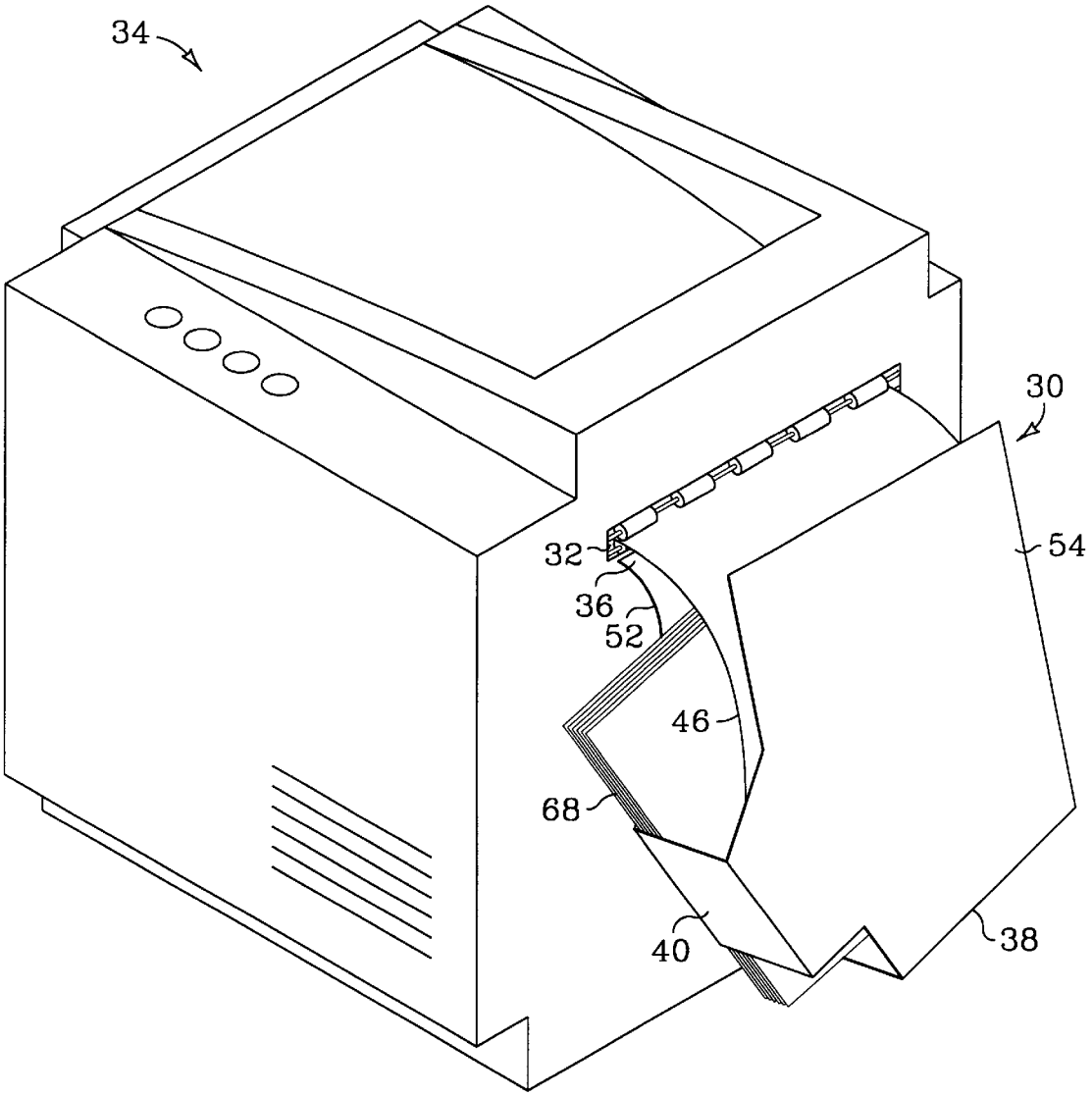
FIG. 12 is a perspective view of one embodiment of the invented sheet media bin coupled to the rear output of a printer in which the tip floor and stop panels are truncated to form an open corner.
Figure 13:
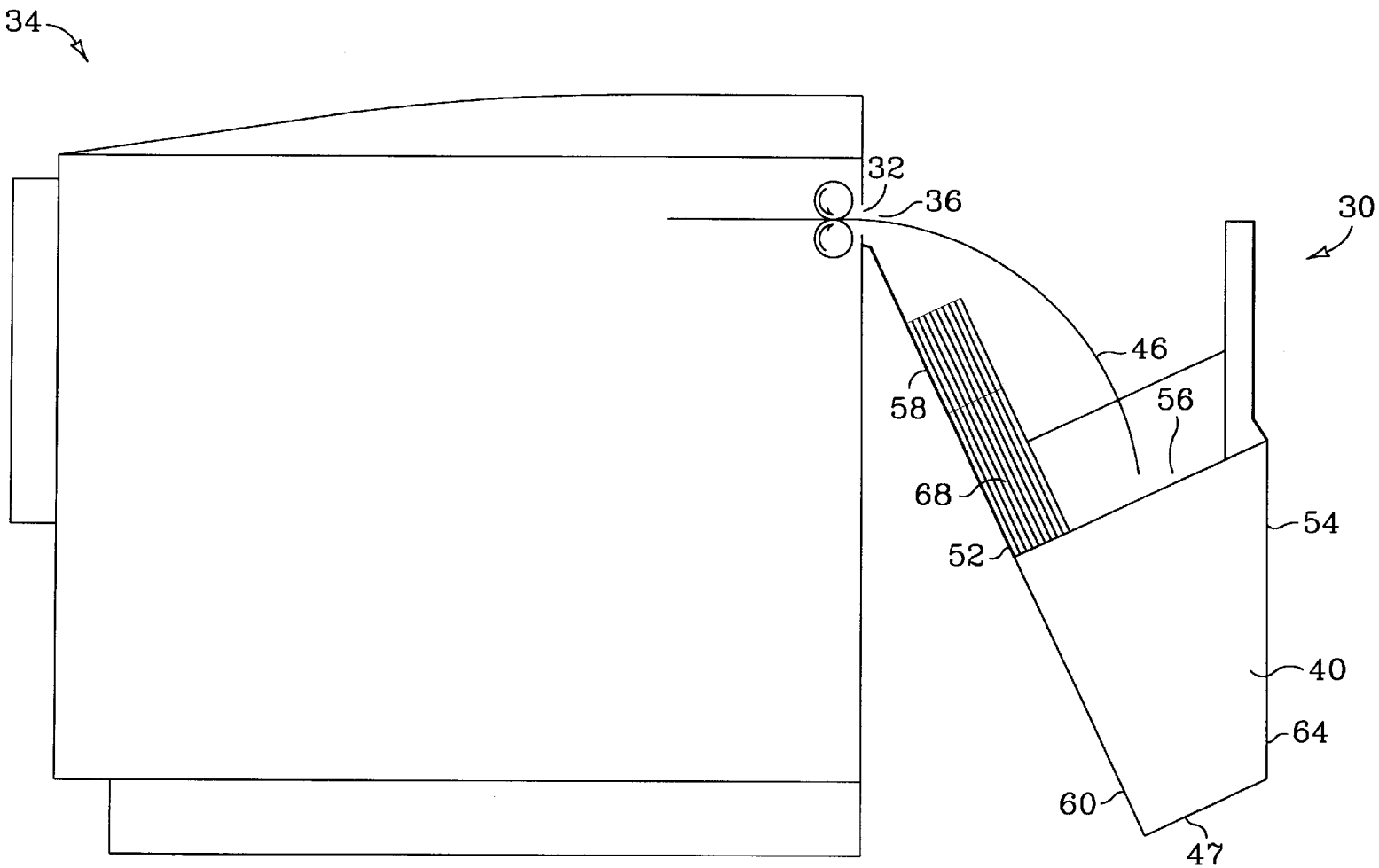
FIG. 13 is an elevation side view of one embodiment in which each sheet falls freely on to the stack.
Figure 14:
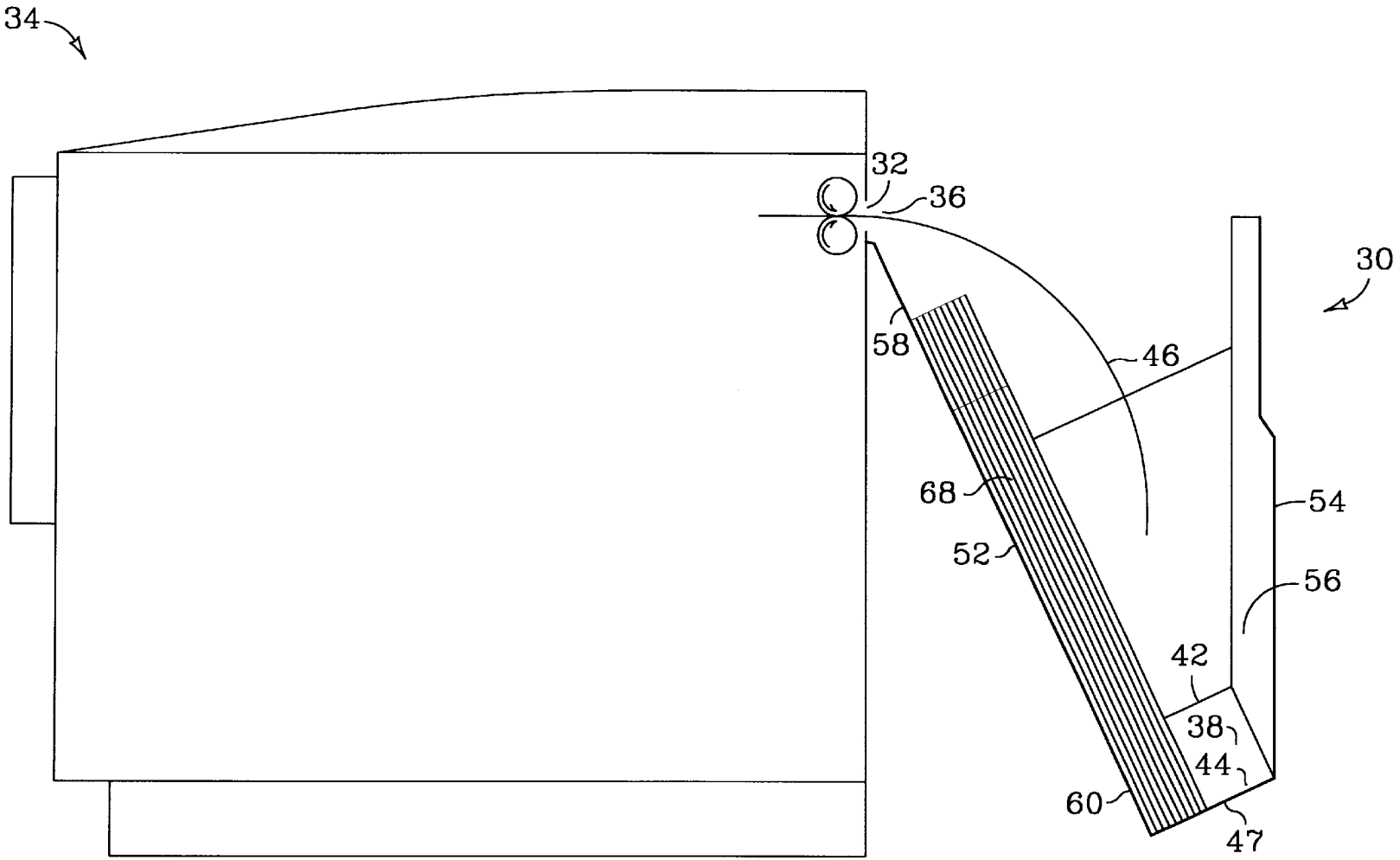
FIG. 14 is a partial cut-away view of the bin of FIG. 13 with the stop removed to view the inside of the bin.

Alternative embodiments are shown in FIGS. 12 and 13–14 to further illustrate the flexibility of the basic bin design. In the embodiment of FIG. 12, floor 38 and stop 40 are truncated to form an open corner. In the embodiment shown in FIGS. 13 and 14, outside panel 54 does not impede or guide the direction of sheets 46. Bin 30 is configured such that sheet 46 falls unhindered onto the stack.

While the previous figures illustrate sheets 46 being dispensed into bin 30 in portrait format—that is with leading edge 48 being the narrower edge of sheet 46—sheet 46 can just as easily be dispensed in landscape format with leading edge 48 being the wider edge of sheet 46.

Figure 15:
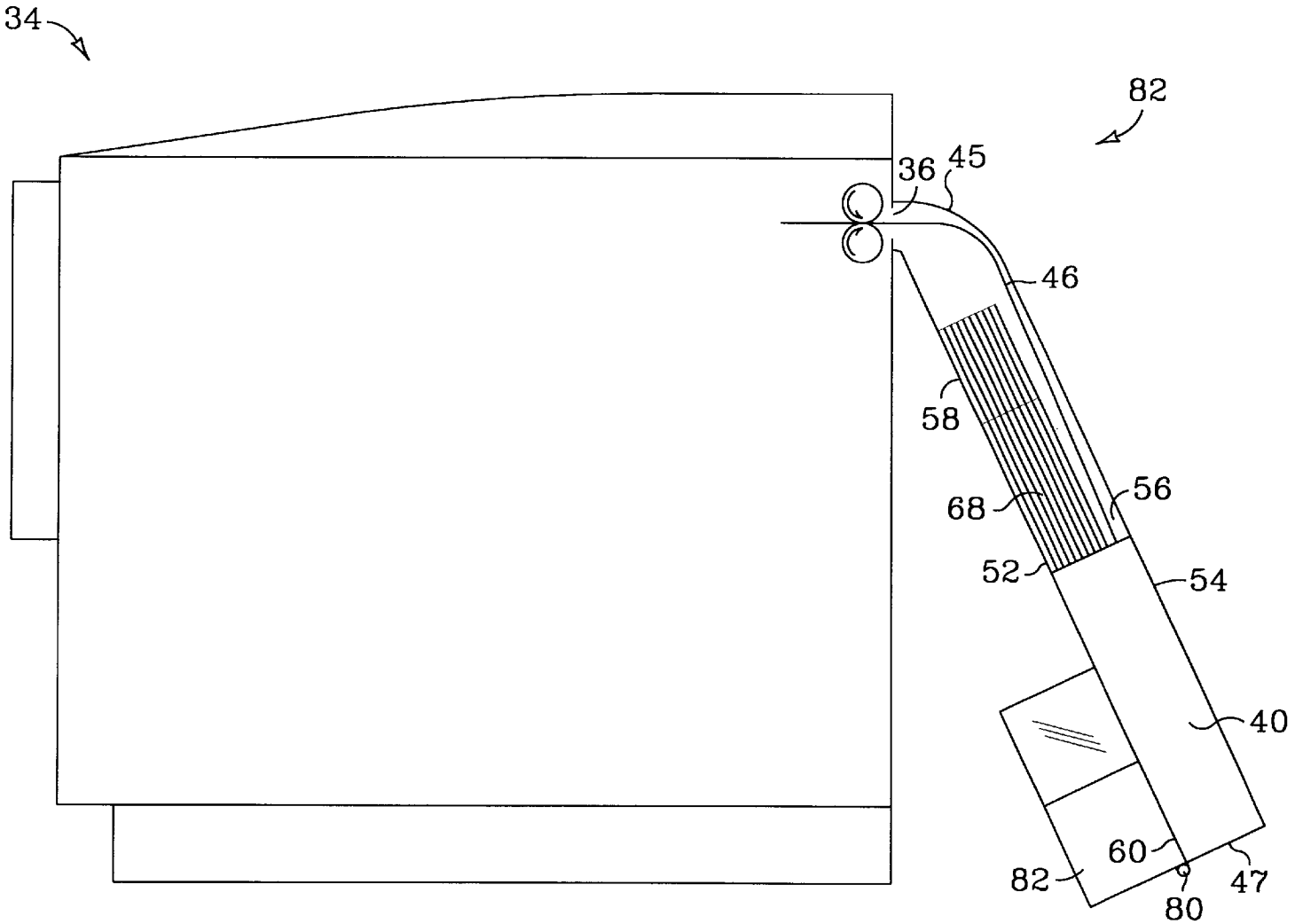
FIG. 15 is a schematic side plan view of one embodiment of the invented bin incorporating a finisher.

In the embodiment illustrated in FIG. 15, bin 30 includes finisher 82. Finisher 82 is configured to perform finishing operations such as binding, stapling, or punching stack 68 aligned and held within bin 30. U.S. Pat. app. Ser. No. 09/320,060 filed on May 26, 1999 entitled "Binding Sheet Media Using Imaging Material", now U.S. Pat. No. 6,394, 728 and U.S. Pat. app Ser. No. 09/482,124 filed Jan. 11, 2000 entitled "Apparatus and Method for Binding Sheet Media" each disclose methods and devices for binding a stack of sheets. Those two applications are hereby incorporated by reference. The methods and devices taught in those applications could be incorporated into bin 30 to provide the ability to bind together leading edges 48 of sheets 46 in aligned stack 68 within bin 30.

What is claimed is:

1. An output bin for a printing device, comprising:

first panel facing each sheet as the sheet is output from the printing device, the first panel having a top, a bottom and a side;

a second panel disposed along the bottom of the first panel, the second panel having an upper portion substantially parallel to a leading edge that leads each sheet out of the printing device and a lower portion tipped relative to the leading edge such that the lower portion of the second panel extends down and away from the upper portion of the second panel; and a third panel disposed along the side of the first panel and intersecting the lower portion of the second panel.

2. A bin for receiving sheets output by a printing device, each sheet having a leading edge that leads the sheet out of the printing device and a side edge perpendicular to the leading edge, the output bin comprising:

a tipped floor having a substantially horizontal upper portion and a lower portion extending down and away from the upper portion; and a stop disposed relative to the floor such that, as the leading edge of each sheet contacts the upper portion of the floor and tips down to the lower portion of the floor, the side edge comes to rest against the stop.

3. The bin of claim 2, wherein the stop and the lower portion of the tipped floor lie in perpendicular planes.

4. The bin of claim 2, further comprising a support panel disposed adjacent to the tipped floor and the stop such that, as the leading edge of each sheet contacts the upper portion of the floor and tips down to the lower portion of the floor, the sheet remains supported, at least indirectly, by the support panel.

5. The bin of claim 4, wherein the support panel occupies a plane perpendicular to the planes occupied by the stop and the lower portion of the floor.

6. The bin of claim 2, further comprising a guide operative to direct the sheets dispensed from the printing device in the direction of the tipped floor.

7. The bin of claim 2, further comprising a finisher operative to perform finishing operations on sheets aligned in the bin.

8. The bin of claim 7, wherein the finishing operation includes binding together the leading edges of the sheets aligned in the bin.

9. A bin for aligning sheets dispensed from a printing device, the bin comprising:

spaced apart first and second panels defining a channel in which media sheets are contained, each panel having opposing first and second portions, the first portions defining an input for receiving sheets;

a tipped floor located between the second portions of the first and second panels, the tipped floor having a first portion located a first distance from the input and a second portion located a second distance, greater than the first distance, from the input; and a stop located adjacent to the second portion of the tipped floor; wherein as a leading edge of each sheet is received through the input, each sheet passes through the channel until its leading edge makes contact with the first portion of the tipped floor, the sheet then tips in the directions of the second portion of the tipped floor with at least a portion of a side edge of the sheet ultimately resting against the stop.

10. The bin of claim 9, wherein the input is located adjacent to an output of the printing device and the panels extend down and away from the output at a selected angle.

11. The bin of claim 9, wherein the panels occupy parallel planes and the stop and second portion of the tipped floor occupy planes that are perpendicular to one another and to the parallel planes.

12. The bin of claim 9, wherein the first portion of at least one panel includes a guide operative to direct sheets from the output of the printing device toward the tipped floor.

13. The bin of claim 9 further comprising a feeder operative to urge the sheets in the direction of the tipped floor as to align the leading edge with the tipped floor and the side edge with the stop.

14. The bin of claim 13, wherein the feeder comprises a plurality of flexible fingers extending radially outward and selectively located around the circumference of a rotating shaft, the fingers being operative to sequentially contacting and urge each sheet as the shaft rotates.

15. The bin of claim 9, wherein at least one panel includes a joint allowing the first portion of that panel to be pivoted between an open position and a closed position, the open position allowing access and removal of sheets contained in the channel.

16. The bin of claim 9, wherein the tipped floor is pivotable between an open position and a closed position, the closed position allowing the tipped floor to support the sheets collected in the bin and the open position allowing to tipped sheets collected in the bin to slide out under the force of gravity.

17. The bin of claim 9, further comprising a finisher operative to perform finishing operations on sheets aligned in the bin.

18. The bin of claim 17, wherein the finishing operation includes binding together the leading edges of the sheets aligned in the bin.

* * * * *